US006338543B1

(12) United States Patent
Lindenfelser

(10) Patent No.: US 6,338,543 B1
(45) Date of Patent: Jan. 15, 2002

(54) METHODS AND APPARATUS FOR THERMALLY-INSENSITIVE MOUNTING OF MULTIPLE ACTUATORS

(75) Inventor: William M. Lindenfelser, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/693,842

(22) Filed: Oct. 23, 2000

(51) Int. Cl.[7] ..... B41J 2/145; B41J 2/15; B41J 2/015

(52) U.S. Cl. ..... 347/40; 347/20

(58) Field of Search ..... 347/40, 14, 19, 347/20

(56) References Cited

U.S. PATENT DOCUMENTS 4,675,696 A * 6/1987 Suzuki ..... 347/14
5,771,050 A * 6/1998 Gielen ..... 347/19
6,172,689 B1 * 1/2001 Cunnagin et al. ..... 347/8

* cited by examiner

*Primary Examiner*—Thinh Nguyen
(74) *Attorney, Agent, or Firm*—Oliff & Berridge, PLC

(57) ABSTRACT

A method and apparatus for controlling the spacing of actuators within a common carriage or frame of a multiple actuator device is provided to render the actuator spacing insensitive to thermal deviations occurring among actuators due to variable thermal conditions within the carriage or frame. A first fixed actuator is connected to an underlying carriage or frame supporting a plurality of actuators and to each additional actuator via links of at least two dissimilar material, such that the respective coefficients of thermal expansion of the dissimilar materials enables the actuators to maintain their original spacing with respect to one another regardless of the thermal conditions within the carriage or frame.

54 Claims, 8 Drawing Sheets

METHODS AND APPARATUS FOR THERMALLY-INSENSITIVE MOUNTING OF MULTIPLE ACTUATORS

BACKGROUND OF THE INVENTION

1. Field of Invention

The invention relates to making a multiple actuator device insensitive to thermally-induced expansions and contractions.

2. Description of Related Art

In existing thermal ink jet printing devices, the printhead cartridge comprises one or more ink-filled printheads. In a common design for an ink jet printer, the cartridge is mounted upon a movable carriage. The printheads of the object printer are arranged opposite a sheet of recording medium on which an image is to be printed. During printing, the cartridge is moved with the carriage across the sheet in repeatable swaths to form an image, much like a typewriter. During non-printing, the cartridge is at rest awaiting instructions from, for instance, an electronic controller. In another common ink jet printer design, the cartridge is stationary and the paper is moved across an array of printhead nozzles that span the full-width of the cartridge. In yet another multi-head device, for example, a charged coupled device (CCD) array having a plurality of sensor heads, the sensor heads receive varying color and image information for subsequent reproduction on a recording medium.

SUMMARY OF THE INVENTION

Mounting the sensor or print-heads on the carriage of a multi-head device requires the multi-heads to be initially spaced apart a designated, or nominal, distance relative to the other respective heads. Thus, when the temperature of the carriage on which all of the printheads, or sensor heads, are mounted changes, the carriage undergoes thermal expansion or contraction. Whenever the temperature of the carriage changes from a nominal temperature, at which the heads are at the nominal spacing, the thermal expansion or contraction of the carriage will cause the actual spacing between the printheads, or sensor heads, to differ from the nominal spacing. As a result, ink droplets are deposited on the recording medium at improper locations in the case of a multi-head printer. Similarly, image data is received at improper locations in the case of, for example, a CCD sensor array. Thus, the thermally-induced movement of the printheads or sensor heads tends to cause a mis-registration of colors or print images, or of sensed color separation layers, of due to improper, or at least inconsistent, positioning of the printheads or sensor heads relative to one another.

Precision placement of ink droplets, or the precision reception of image data, is essential to lessen contaminating color shifts, or blurring or shifting of colors that otherwise occur due to thermal expansion of the carriage the plurality of printheads, or sensor heads, are mounted upon. The correct droplet, or pixel, alignment becomes increasingly important in high-end printing, such as photographic printing or acoustic inkjet printing, in which very small droplets of ink are used.

This invention provides apparatus that are insensitive to thermally-induced spacing variations between multiple actuators, such as printheads or sensor heads, in a multi-actuator device. This invention separately provides methods and apparatus that increase the efficiency of image generating multi-actuator devices. This invention also separately provides methods and apparatus resulting in precision placement of image producing materials for accurate image reproductions and increased color clarity.

The methods and apparatus of the invention are derived, in part, from an $18^{th}$ century application for controlling pendular motions in clocks. In the pendular motion controlling technique, materials having different thermal expansion properties carefully controlled the effective swing length of a clock's pendular arm. By using materials of known thermal expansion properties, the time period of the pendular swing was consistently controlled relative to gears within the clock casing housing the pendular arm and the clock's gears. The technique permitted the precision necessary for proper and consistently reliable time-keeping notwithstanding the changing thermal conditions the clock was subjected to. In the systems and methods according to this invention, that concept is applied to control spacing in multi-actuator devices.

Further, while previous printers required manual correction of the multiple printheads of an image producing device to achieve proper alignment of the multiple printheads relative to one another, the methods and apparatus according to this invention reduces the need for manual correction, decreasing the occurrence of human error and increasing the precision placement of ink droplets, or the precision reception of image data. As a result, multiple actuator imaging devices are easier to operate and become more effective.

In various exemplary embodiments of the invention, the spacing between multiple actuators, such as printheads or sensor heads, is controlled or rendered insensitive to thermally-induced expansion or contraction by fixing a first actuator to an underlying common carriage or frame. All of the other actuators are linked to the first actuator by links of two dissimilar materials having different coefficients of thermal expansion. In particular, the other actuators are not fixed to the carriage or frame. Instead, the other actuators are "cantilevered" off, i.e., fixed to, the first actuator by the link and are merely supported by the carriage or frame. In other words, the other actuators "float" relative to the carriage or frame. As a result, when the underlying carriage or frame undergoes thermal expansion or contraction, the distance between the linked actuators remains constant. This tends to reduce, if not eliminate, thermally-induced spacing shifts between the actuators. In a printer having printheads as the actuators, this also tends to improve the placement of the ink droplets ejected from each printhead onto the recording medium. In a scanner having multiple CCD array sensor heads as the actuators, the reception of image data by a sensor head for subsequent reproduction onto a recording medium is improved. In CCD array sensor heads, for example, the reduction of thermally-induced spacing shifts tends to reduce mis-registration between the various color separations.

Thus, the apparatus and methods according to this invention reduce the need for an operator to manually correct the spacing between actuators due to thermally-induced spacing shifts. Further, the apparatus and methods according to this invention enable the proper ink droplet placement onto a recording medium in a multiple printhead ink jet printer to be maintained. The apparatus and methods according to this invention make a multiple actuator image forming or printing process easier and more precise than previous multiple actuator image forming or printing devices.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENT(S)

Figure 1:
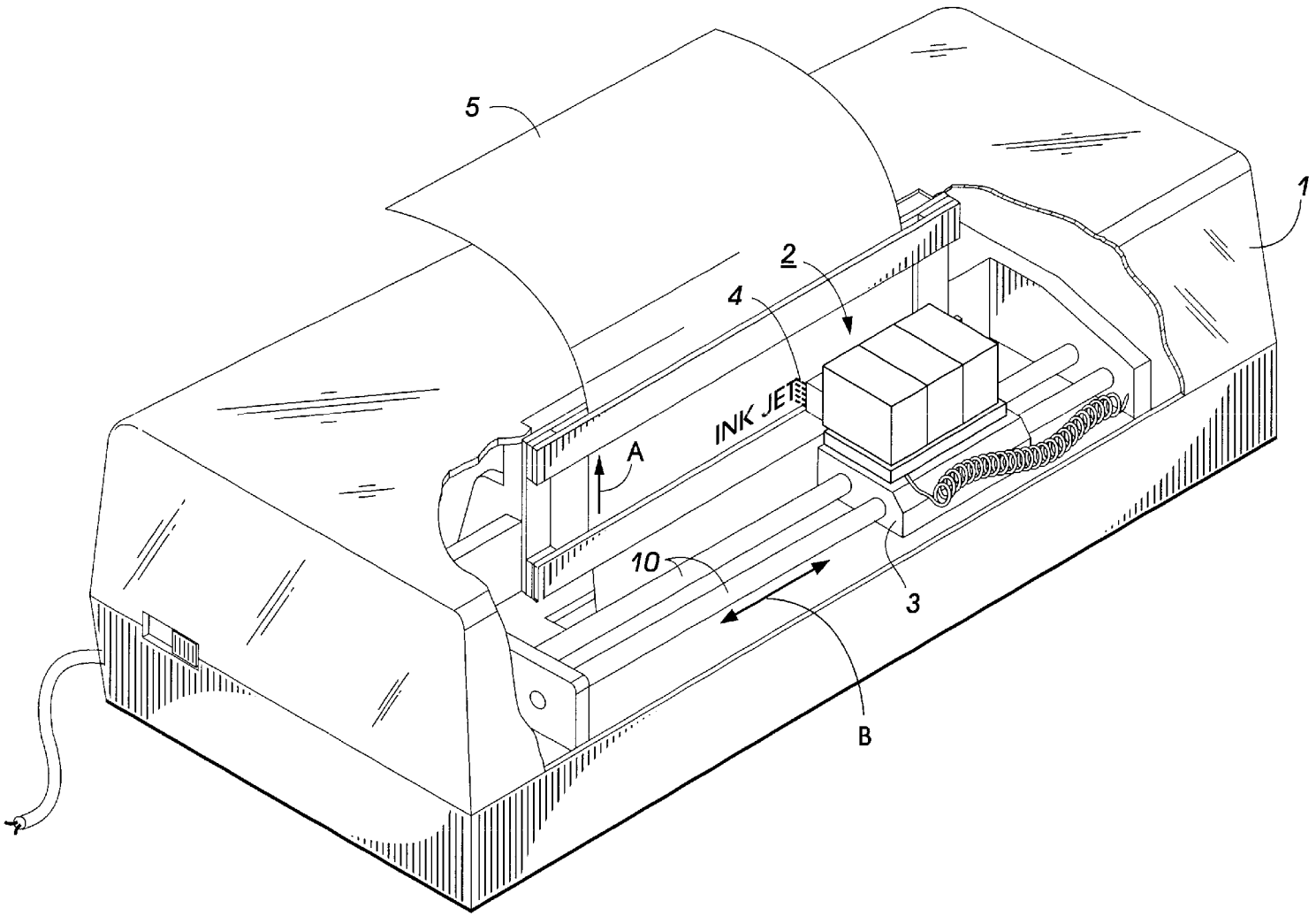
FIG. 1 is a perspective view of an ink jet printer including a movable printhead cartridge.
Figure 2:
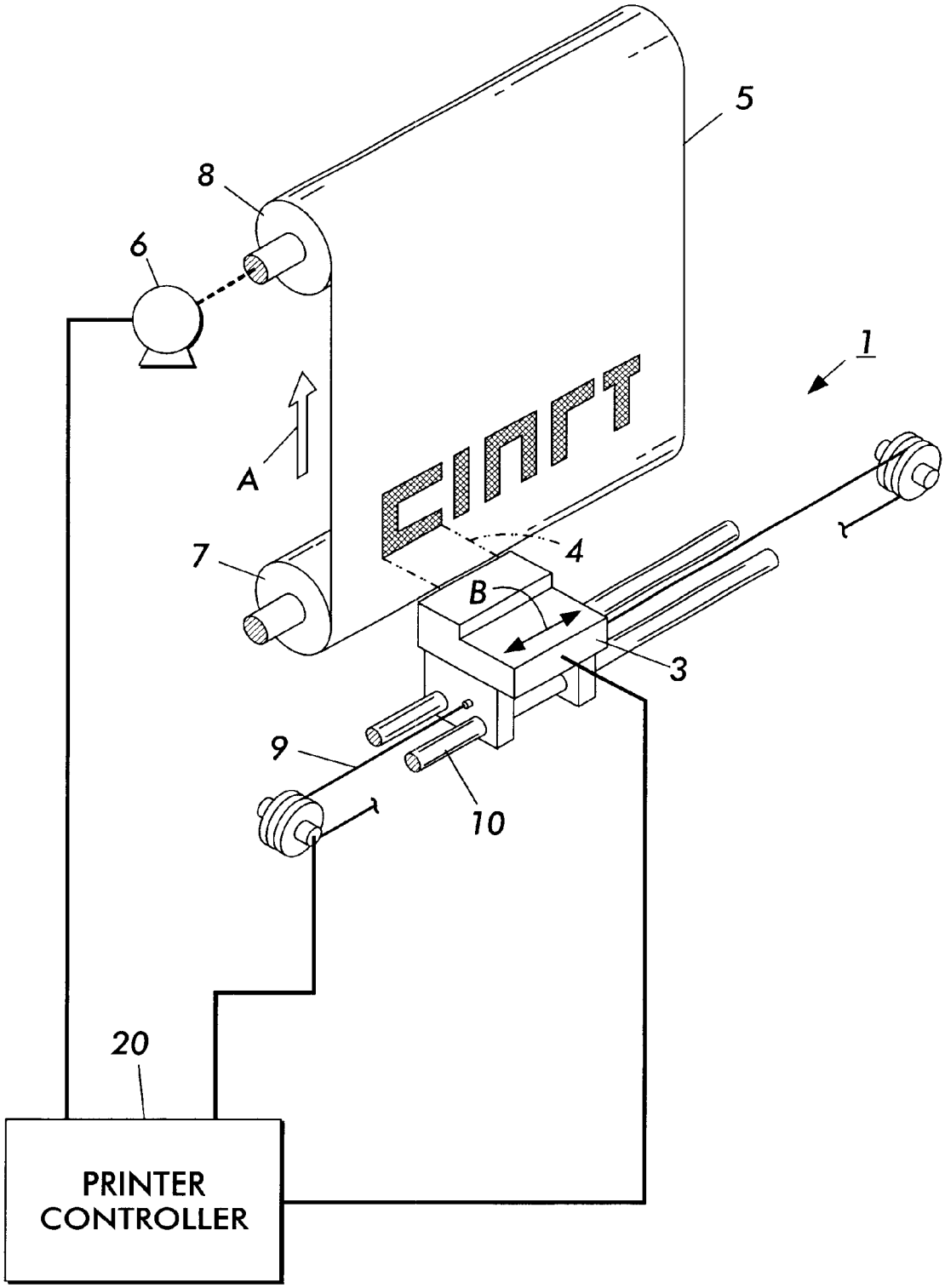
FIG. 2 is a schematic view of a movable printhead cartridge and related structures of an ink jet printer.

FIG. 1 shows a perspective view of one exemplary embodiment of an exemplary carriage-type ink jet printing device 1. FIG. 2 shows a schematic view of one exemplary embodiment of the carriage and related structures of the ink jet printer 1 shown in FIG. 1. A linear array of ink-droplet producing channels are housed within each of a plurality of printhead cartridges 2 mounted upon a reciprocal carriage 3. The array of ink-droplet producing channels extends along a first direction, indicated by the arrow A, i.e., the printing direction. Ink droplets 4 are propelled onto a recording medium 5, such as a sheet of paper, that is stepped a preselected distance (often equal to the size of the array), often by a motor 6, in the printing direction A each time the carriage 3 and the printhead cartridges 2 traverse across the recording medium 5 along the swath axis B. The recording medium 5 can be stored on a supply roll 7 and stepped onto takeup roll 8 by the motor 6, or can be stored in and/or advanced using other structures, apparatuses or devices well known to those of skill in the art.

The printhead cartridges 2 are mounted, for instance on a support base 9, and move reciprocally in the swath axis B direction using any well-known structure, apparatus or device, such as two parallel guide rails 10. The printhead cartridges 2 generally move across the recording medium 5 perpendicularly to the direction in which the recording medium 5 moves. Of course, other structures for reciprocating the carriage 3 are possible.

The ink jet printing device 1 is operated under the control of a print controller 20. The print controller 20 transmits commands to the motor 6 and to the printhead cartridges 2 to produce an image on recording medium 5.

Figure 3:
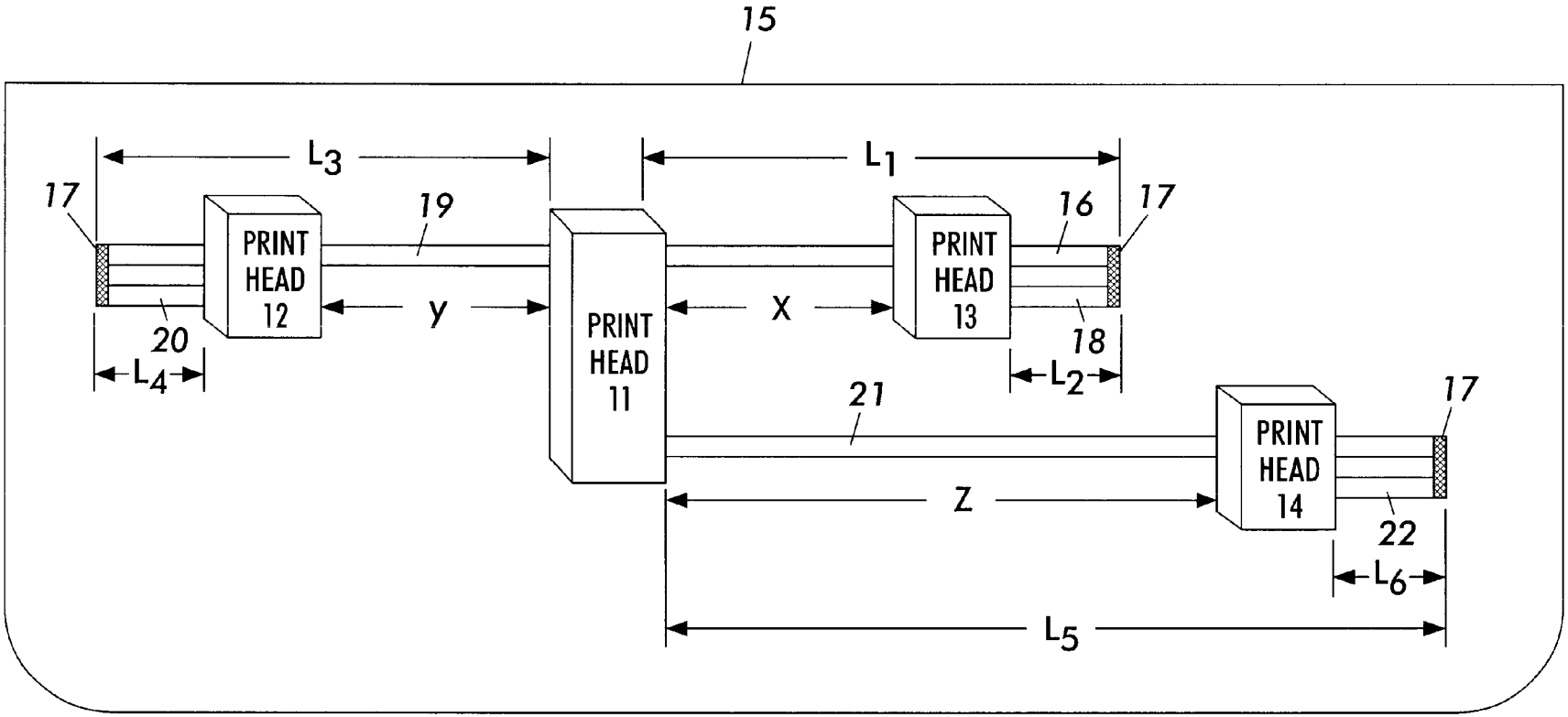
FIG. 3 is a schematic view of a first exemplary embodiment of four linked multiple printheads, or sensor heads, according to this invention.

FIG. 3 shows a number of heads 11, 12, 13 and 14 of the printhead cartridge 2 provided on the carriage 3. It should be appreciated that FIG. 3 is schematic only and is not intended to show scale. All of the printheads 12, 13 and 14 are positioned linearly relative to the printhead 11. As shown in FIG. 3, the printhead 11 is fixed to the carriage 3, while the printheads 12–14 are not directly connected to the carriage 3. That is, the printheads 12–14 may be supported by the carriage 3, but are not fixed or attached directly to the carriage 3. The printhead 13 is linked to the first printhead 11 a distance x on one side of the printhead 11. The distance x is a design, or nominal, distance. A first link 16, having an appropriate physical structure and made of a first material, connects the first printhead 11 to a linking structure 17. The first link 16 has a length L1 extending from the first printhead 11 on one end to the linking structure 17 on the opposite end furthest from the printhead 11. The first link 16 has a property of thermal expansion, $\mu 1$, known as its thermal expansion co-efficient.

At the end of the first link 16 furthest from the printhead 11, the linking structure 17 connects the first link 16 to a second link 18. The linking structure 17 provided between the first and second links 16 and 18 may be any known or later developed structure or device or mechanism usable to attach together the links 16 and 18, such as a pin, a weld or the like. Of course, it should be appreciated that the linking structure 17 can be the end portions of each of the links 16 and 18 that have been suitably formed and arranged relative to each other so that the links 16 and 18 can be connected directly to each other by welding, brazing, gluing, or fastening. In this case, the linking structure 17 need not be an independent element that is physically distinct from the links 16 and 18.

The second link 18 has an appropriate physical structure and is made of a second material. The second link 18 extends a length L2 extending from the linking structure 17 back towards the first printhead 11 before connecting to the printhead 13. The second link 18 has a thermal expansion co-efficient $\mu_2$ different than the thermal expansion co-efficient $\mu_1$ of the first link 16. The lengths, L1 and L2, and the coefficients of thermal expansion, $\mu_1$ and $\mu_2$, of the first and second links 16 and 18, respectively, are selected such that:

$$L1-L2=x; \text{ and} \tag{1}$$

$$\mu_1 L1=\mu_2 L2 \tag{2}$$

where:

- L1 is the length of the first link 16, i.e., the distance between the first printhead 11 and the linking structure 17;
- L2 is the length of the second link 18, i.e., the distance between the printhead 13 and the linking structure 17;
- $\mu_1$ is the thermal expansion co-efficient for material of the first link 16;
- $\mu_2$ is the thermal expansion co-efficient for material of the second link 18; and
- x is the design, or nominal, distance between the first printhead 11 and the printhead 13.

As a result of the relationship between L1, L2, $\mu_1$ and $\mu_2$, the design, or nominal, distance x is maintained between the fixed first printhead 11 and the printhead 13 during a printing or sensing process, notwithstanding the varying thermal conditions. That is, while the printhead 11 remains in its originating position relative to the carriage 3 since it is fixed to the carriage 3, the position of the printhead 13 relative to the fixed first printhead 11 does not change, even though the position of the printhead 13 relative to the carriage 3 changes according to the instantaneous temperature of the carriage 3 and the first and second links 16 and 18. If the ambient temperature in or around the printer carriage 3 causes the first link 16 to expand in accordance with the thermal expansion properties $\mu_1$ of the first link 16, shifting the printhead 13 away from the first fixed printhead 11, then the thermal expansion properties $\mu_2$ of the second link 18 will expand a similar amount in the opposite direction in order to maintain the design, or nominal, distance x between the printheads 11 and 13. Similarly, if the carriage temperature causes a thermally-induced contraction of the first link 16, thus drawing the printhead 13 toward printhead 11, then the thermal expansion properties $\mu_2$ of the second link 18 causes the second link 18 also to contract, thus drawing the printhead 13 away from the printhead 11 in an equal amount, again maintaining the design, or nominal, distance x spacing originally established between the printheads 11 and 13.

FIG. 3 also shows the relationship of the printhead 12 relative to the fixed printhead 11 as well. The printhead 12, in this instance, is positioned on the opposite side of the printhead 11 relative to the printhead 13. Similar to the originating design, or nominal, distance x position of printhead 13 relative to fixed printhead 11, the printhead 12 has an originally established design, or nominal, distance y relative to the printhead 11. Similarly to the printhead 13, the printhead 12 is connected to the printhead 11 by a third link 19, a linking structure 17 and a fourth link 20. The third and fourth links 19 and 20 will be formed of materials having coefficients of thermal expansion $\mu_3$ and $\mu_4$, respectively, and will have lengths $L_3$ and $L_4$, respectively, such that:

$$L_3-L_4=y; \text{ and} \tag{3}$$

$$\mu_3L_3=\mu_4L_4; \tag{4}$$

where:

- L3 is the length of the third link 19, i.e., the distance between the first printhead 11 and the linking structure 17;
- L4 is the length of the fourth link 20, i.e., the distance between the printhead 12 and the linking structure 17;
- $\mu_3$ is the thermal expansion co-efficient for material of the third link 19;
- $\mu_4$ is the thermal expansion co-efficient for material of the fourth link 20; and
- y is the design, or nominal, distance between the first printhead 11 and the printhead 12.

In particular, it should be appreciated that the third and fourth links 19 and 20 can be formed of the same materials as the first and second links 16 and 18, respectively, or could be formed of any other combination of materials having the appropriate coefficients of thermal expansion. Of course, if the links 16 and 19, and the links 18 and 20, are respectively formed of the same materials, the lengths $L_3$ and $L_4$ will be related to the lengths $L_1$ and $L_2$, respectively, by the ratio of y to x. Thus, if y is twice x (y=2x), the lengths $L_3$ and $L_4$ will be twice the lengths $L_1$ and $L_2$, respectively ($L_3=2L_1$; $L_4=2L_2$).

Thus, like the printhead 13, the position of the printhead 12 relative to the printhead 11 will remain essentially constant. At the same time, any spacing change occurring to the printhead 12 relative to the carriage 3 would therefore occur at the same y:x ratio of thermal expansion or contraction provided to the printhead 13 whenever a temperature-induced expansion or contraction of the first-fourth links 16 and 18–20 occurs, as all of the links 16 and 18–20 would be subject to the same thermal conditions within the carriage 3. Thus, the design, or nominal, distance y of the printhead 12 from the printhead 11 is controlled by the inversely-oriented expansion or contraction in equal amounts of the third and fourth links 19 and 20 for the printhead 12. Again, the relationship between the lengths, $L_3$ and $L_4$, and the coefficients of thermal expansion $\mu_3$ and $\mu_4$ of the third and fourth links 19 and 20, compensate for any thermally-induced spacing changes experienced by the printhead 12 relative to the carriage 3.

FIG. 3 also shows a third printhead 14 that is independently linked to the printhead 11 at approximately a design, or nominal, distance z from the printhead 11. Similarly to either of the printheads 12 or 13, the printhead 14 is connected to the printhead 11 by a fifth link 21, a linking structure 17 and a sixth link 22. The fifth and sixth links 21 and 22 will be formed of materials having coefficients of thermal expansion $\mu_5$ and $\mu_6$, respectively, and will have lengths L5 and L6, respectively, such that:

$$L5-L6=z; \text{ and} \tag{5}$$

$$\mu_5L5=\mu_6L6 \tag{6}$$

where:

- L5 is the length of the fifth link 21, i.e., the distance between the first printhead 11 and the linking structure 17;
- L6 is the length of the second link 22, i.e., the distance between the printhead 14 and the linking structure 17;
- $\mu_5$ is the thermal expansion co-efficient for material of the fifth link 21;
- $\mu_6$ is the thermal expansion co-efficient for material of the sixth link 22; and
- z is the design, or nominal, distance between the first printhead 11 and the printhead 14.

In particular, it should be appreciated that the fifth and sixth links 21 and 22 can be formed of any of the same materials as any of the first through fourth links 16 and 18–20, respectively, or could be formed of any other combination of materials having the appropriate coefficients of thermal expansion. Of course, if the links 16 and 21, and the links 18 and 22, are respectively formed of the same materials, the lengths $L_5$ and $L_6$ will be related to the lengths $L_1$ and $L_2$, respectively, by the ratio of z to x. Thus, if z is three-times x (y=3x), the lengths $L_5$ and $L_6$ will be three-times the lengths $L_1$ and $L_2$, respectively ($L_5=3L_1$; $L_6=3L_2$).

Thus, like either of the printheads 12 or 13, the position of the printhead 14 relative to the printhead 11 will remain essentially constant. At the same time, any spacing change occurring to the printhead 14 relative to carriage 3 would therefore occur at the same z:x ratio of thermal expansion or contraction provided to printhead 13 whenever a temperature-induced expansion or contraction of the first-sixth links 16 and 18–22 occurs, as all would be subject to the same thermal conditions within the carriage 3. Thus, again the design, or nominal, distance z of the printhead 14 from printhead 11 is controlled by the inversely-oriented expansion or contraction in equal amounts of the fifth and sixth links 21 and 22 for the printhead 14. Again, the relationship between the lengths, $L_5$ and $L_6$, and the coefficients of thermal expansion $\mu_5$ and $\mu_6$ of the fifth and sixth links 21 and 22, compensate for any thermally-induced spacing changes experienced by the printhead 12 relative to the carriage 3.

As should be appreciated from the various descriptions of FIG. 3 above, any combination of materials may be used to form the pairs of links 16 and 18, 19 and 20, and 21 and 22, provided their respective thermal expansion coefficients $\mu$ combine to offset the expansion or contraction of one link of the pair, for example the first link 16, by the expansion or contraction of the other link, for example the second link 18, in an equal amount in an opposite direction. The inversely-oriented expansions or contractions of the first and second links of the pair of links maintain the design, or nominal, distances x, y, or z, originally established for the respective printheads, 12, 13, or 14 relative to the first fixed printhead 11 regardless of the thermal conditions present.

In other words, when the underlying carriage 3 supporting the printheads 11, 12, 13 and 14 undergoes a thermal expansion or contraction, only the first printhead 11 moves, because only the first printhead 11 is fixed to the carriage 3. The other printheads 12, 13 and 14 remain in their original positions relative to printhead 11. Only when a temperature sufficient to induce expansion or contraction of the materials of the pairs of links exists are the positions of the other printheads 12, 13 and 14 changed relative to the carriage 3. However, even when the positions of the printheads 12, 13 and 14 relative to the carriage 3 change, the relationships of lengths of the first and second links of each pair of links and the respective coefficients of thermal expansion of the first and second links of each pair of links are such that the first and second links of each pair of links expand or contract equal amounts in opposite directions to maintain the desired original spacing between the printhead 11 and the printheads 12, 13 and 14.

Of course, it should be appreciated that while FIG. 3 shows a series of four printheads 11, 12, 13 and 14, any number of printheads could be used with similar link configurations to maintain desired spacing between the fixed printhead and those printheads.

It should also be appreciated that the configuration shown in FIG. 3 depicting the printheads, 11, 12, 13 and 14 equally depicts embodiments where sensor heads are used in place of the printheads. Further, the configuration of the plurality of printheads 11, 12, 13 and 14 shown in FIG. 3 equally depicts configurations where the printheads 11–14 are stationary full-width print bars, or sensor bars. In this case, one of the full width print bars, or sensor bars, is fixed to a stationary frame member or the like of the apparatus. The other full-width print bars or sensor bars are then connected to the fixed print bar or sensor bars in the same manner that the printhead 11 is connected to the carriage 3 and the other printheads 12–14 are connected to the printhead 11 as shown in FIG. 3.

Of course, in any of the embodiments set forth, the printheads, or sensor heads, are merely specific examples of any type of actuator that input or output information data, where the actuators, forming a set of actuators, are desirably maintained at predetermined distances from each other.

Figure 4:
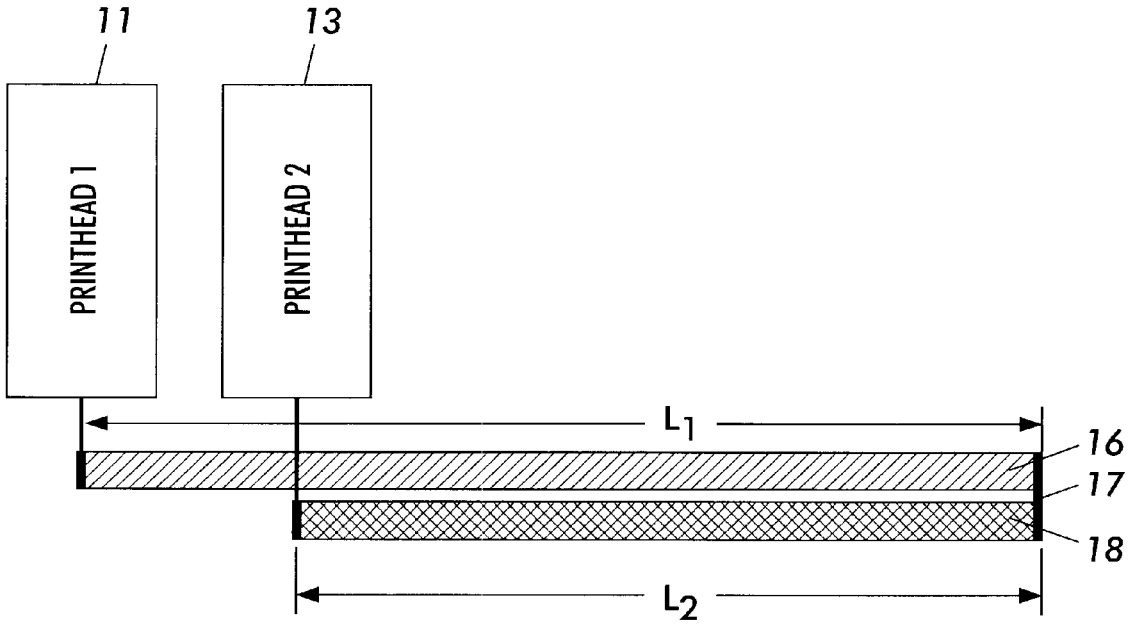
FIG. 4 is a schematic view of the first exemplary embodiment of showing two linked multiple printheads, or sensor heads, according to this invention.

FIGS. 5–8 shows four additional exemplary configurations for connecting the printhead 11 and one or more of the printheads 12–14 differently than that shown in FIG. 3. The relationship shown in FIG. 3 between the printhead 13 and fixed printhead 11 is illustrated in FIG. 4 as a reference to explain the differences of the additional exemplary configurations. In particular, the 1-fold configuration shown in FIG. 4 illustrates the configuration of the printheads 11 and 13 shown in FIG. 3. In FIG. 4, the printhead 13 is linked to the fixed first printhead 11 using a pair of links 16 and 18. The first link 16 extends the length L1 from the first printhead 11 to the linking structure 17, while the second link 18 extends the length L2 from the linking structure 17 back towards the printhead 11 to the printhead 13. The lengths L1 and L2 of the first and second links 16 and 18 maintain the original design, or nominal, distance x between the printhead 11 and the printheads 13 because of the coefficients of thermal expansion $\mu_1$, $\mu_2$ associated with the link 16 and 18, respectively.

Figure 5:
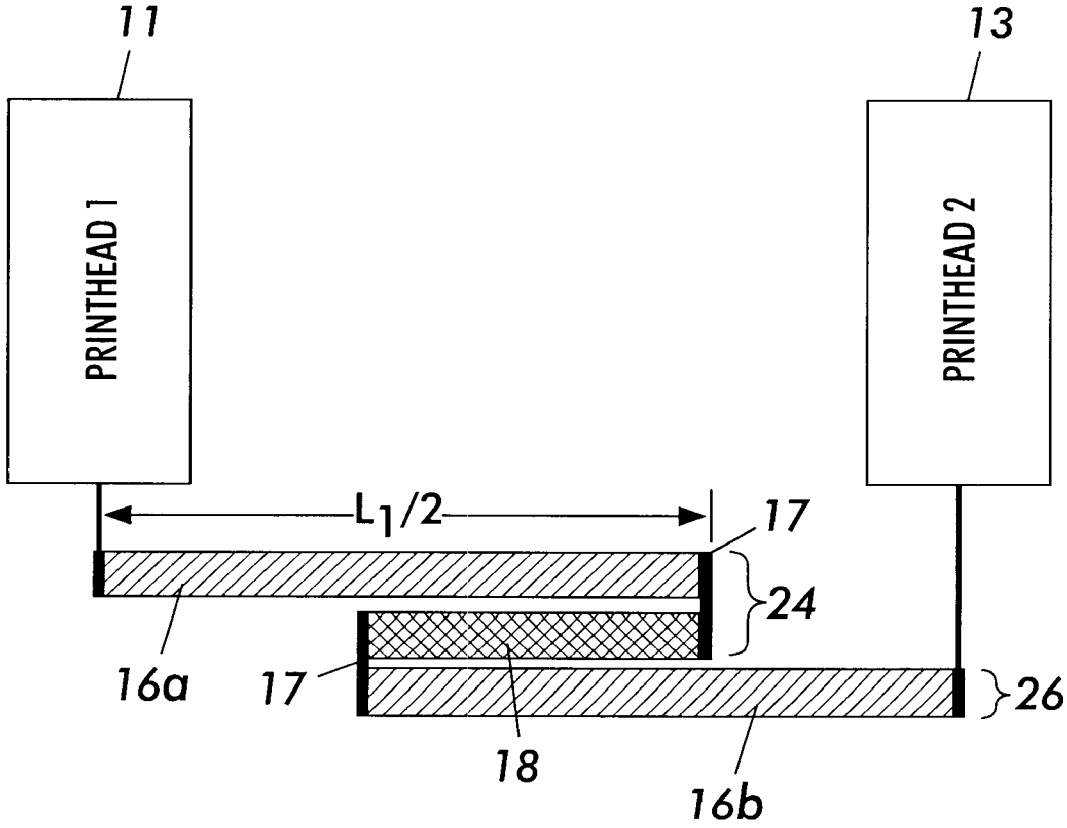
FIG. 5 is a schematic view of a second exemplary embodiment showing two linked multiple printheads, or sensor heads, according to this invention.
Figure 6:
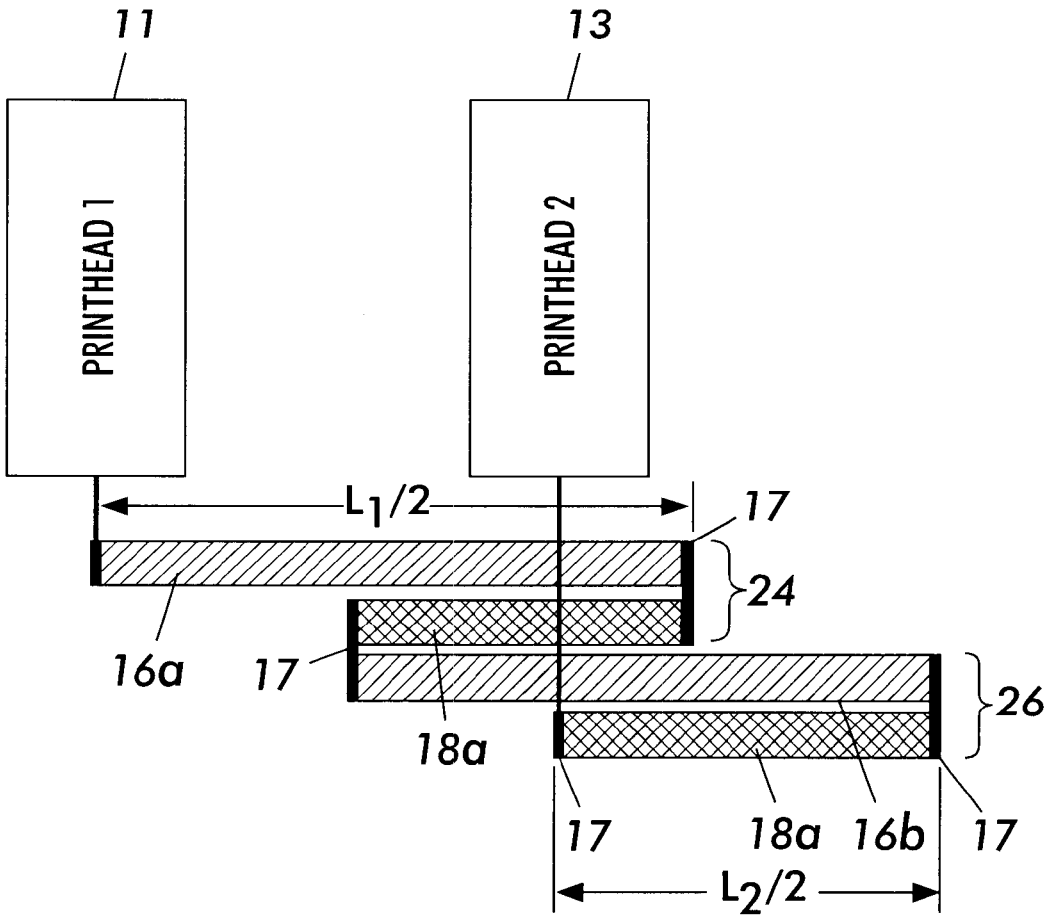
FIG. 6 is a schematic view of a third exemplary embodiment showing two linked multiple printheads, or sensor heads, according to this invention.
Figure 7:
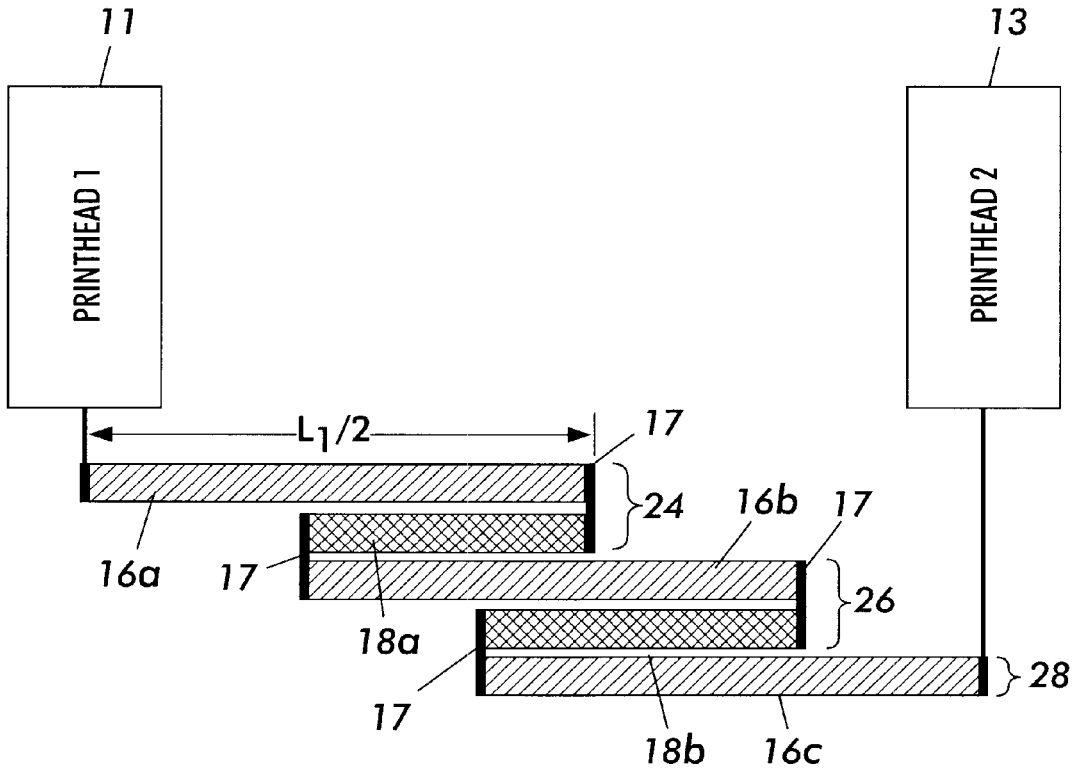
FIG. 7 is a schematic view of a fourth exemplary embodiment showing two linked multiple printheads, or sensor heads, according to this invention.
Figure 8:
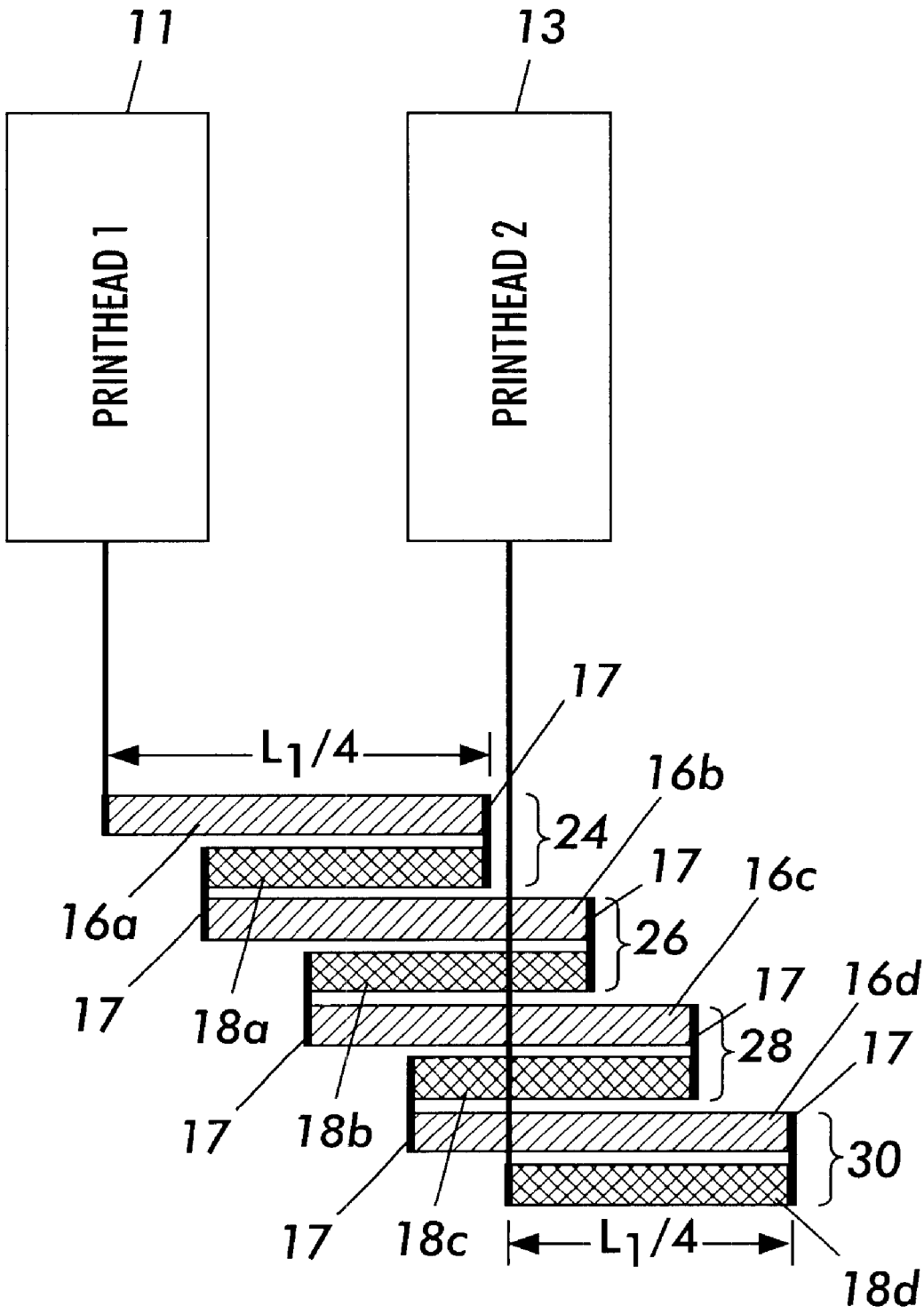
FIG. 8 is a schematic view of a fifth exemplary embodiment showing two linked multiple printheads, or sensor heads, according to this invention.

The additional exemplary configurations shown in FIGS. 5–8 illustrate that the same printhead spacing thermal insensitivity achieved by the matched thermal expansions of the pair of first and second links 16 and 18 may be achieved incrementally by dividing one or both of the first and second links 16 and 18 into, for example, one or more sublinks that each have a length that is less than the corresponding length $L_1$ and/or $L_2$ of the links 16 and 18 in the 1-fold configuration shown in FIG. 4. In FIGS. 5–8, a first layer 24 thus comprises the pair of a first sublink 16*a* and either the link 18 or a first sublink 18*a*, while a second layer 26 includes at least a second sublink 16*b*. As shown in FIGS. 6–8, the second layer 26 comprises the pair of second sublinks 16*b* and 18*b*, while a third layer 28 includes at least a third sublink 16*c*. As shown in FIGS. 7 and 8, the links 16 and 18 are divided into the layers 24, 26 and 28 in the 2.5-fold configuration shown in FIG. 7, and the layers 24, 26, 28 and 30 in the 4-fold configuration shown in FIG. 8. The layers 24, 26, 28 and/or 30 are connected using additional linking structures 17, which are similar to the linking structure 17.

The 1.5-fold configuration shown in FIG. 5 and the 2-fold configuration shown in FIG. 6 each illustrates that the same design, or nominal, distance x spacing between the printhead 13 and the fixed printhead 11 may be maintained using the first and second layers 24 and 26 of the sublinks 16*a* and 16*b* and 18*a* and 18*b*. It should also be appreciated that, while FIG. 6 shows the 2-fold configuration as equally dividing the links 16 and 18 into the sublinks 16*a* and 16*b*, and 18*a* and 18*b*, respectively, any of the links 16 and 18 can be divided in any manner to form the sublinks 16*a* and 16*b*, and 18*a* and 18*b*, as shown in the 1.5-fold configuration shown in FIG. 5. Thus, it should further be appreciated that the links 16 and 18 do not have to be divided into equal portions, or even in the same proportions, so long as the sum of the length of the sublinks 16*a* and 16*b*, and 18*a* and 18*b*, equal the lengths $L_1$ and $L_2$, respectively.

Moreover, it should further be appreciated that the sublinks 16*a* and 16*b*, and/or the sublinks 18*a* and 18*b*, need not be formed of the same materials, so long as the total length change per unit of temperature change over the total lengths of the sublinks 16*a* and 16*b* substantially equals the total length change per unit of temperature change over the total lengths of the sublinks 18*a* and 18*b*. Thus, in this case, in the 1.5-fold and 2-fold configuration shown in FIGS. 5 and 6, the total lengths $L_{1a}$ and $L_{1b}$ of the sublinks 16*a* and 16*b* may not necessarily equal the length $L_1$ that would be used for a single link 16 in the 1-fold configuration shown in FIGS. 3 and 4. Likewise, in the 2-fold configuration shown in FIG. 6, the total lengths $L_{2a}$ and $L_{2b}$ of the sublinks 18*a* and 18*b* may not necessarily equal the length $L_2$ that would be used for a single link 18 in the 1-fold configuration shown in FIGS. 3 and 4.

It should further be appreciated that the preceding descriptions of the 1.5-fold and 2-fold configurations shown in FIGS. 5 and 6 equally apply to the 2.5-fold and 4-fold configuration shown in FIGS. 7 and 8, as well as for any other number of layers of links.

Thus, provided the materials forming the pairs of first and second sublinks, 16*a* and 18*a*, and 16*b* and 18*b*, of the first and second layers 24 and 26 have the appropriate lengths and thermal expansion properties, total movement of the links oriented in one direction is inversely offset by an equal total movement of the links oriented in the other direction, so that there is no overall change in the position of the printhead 13 relative to the first printhead 11. Thus, the pairs of first and second links, 16*a* and 18*a*, and 16*b* and 18*b*, of the first and second layers 24 and 26 may comprise a combination of many materials having differing thermal expansion properties to achieve the same space maintaining or compensating quality between the actuators. For example, the first link 16*a* in the first layer 24 may be the same material as that of the first link 16*b* in the second layer 26. Similarly, the material of the second links 18*a* and 18*b* in the first and second layers 24 and 26, respectively, may also be the same. Of course, like materials would exhibit like thermal expansion properties. Thus, the design, or nominal, distance x spacing between printheads 11 and 13 would be maintained in one-half increments using the 2-fold configuration shown in FIG. 6.

It is possible, however, that the first link 16*a* of the first layer 24 would be formed of one material, while the first link 16*b* of the second layer 26 would be formed of another material. Thus, the coefficients of thermal expansion $\mu$ of the links 16*a* and 16*b*, in this instance, would likely be different. Likewise, the second links 18*a* or 18*b* could be made of materials different from each other that have different coefficients of thermal expansion $\mu$ as well. The combination of materials and lengths of the respective sublinks 16*a*, 16*b*, 18*a* and 18*b* will be selected to ensure the design, or nominal, distance x of the printhead 13 from the printhead 11 remains substantially the same. Thus, as long as combinations of links of appropriate thermal expansion properties are provided to compensate for the thermally-induced expansions or contractions of the links, so that the proper spacing of the printheads relative to one another is maintained, then any combination of link materials may be used.

The first and second layers 24 and 26 of the first and second sublinks 16*a* and 16*b*, and 18*a* and 18*b*, necessarily require an additional linking structure 17 to connect these layers to one another. As a result, the design, or nominal distance x, between the printhead 11 and the printhead 13 is substantially maintained using the one-half lengths of the 2-fold configuration shown in FIG. 6, just as the same distance x is substantially achieved using the full lengths L1 and L2 of the links 16 and 18 in the 1-fold configuration shown in FIGS. 3 and 4. The 2-fold configuration of FIG. 6 thus allows the first and second links 16 and 18 to occupy a smaller longitudinal space, which can minimize the size of the carriage 3.

Similarly, the 4-fold configuration shown in FIG. 8 illustrate the first and second links 16 and 18 divided into quarters, so that each of the sub-links 16*a*–16*d* and 18*a*–18*d* have lengths $L_1/4$ and $L_2/4$, respectively. The 4-fold configuration, similarly to the 1.5-fold, 2-fold and 2.5-fold configurations, achieves the same space compensating methods for the printheads 11 and 13 relative to the carriage 3 in even smaller increments using even less longitudinal space than the 1.5-fold, 2-fold and 2.5-fold configurations described above. Again, the materials used for the series of first-fourth sub-links 16*a*–16*d* and 18*a*–18*d* may be any combination of the same or different materials provided the materials have appropriate coefficients of thermal expansion $\mu$ for the lengths of the sub-links 16*a*–16*d* and 18*a*–18*d* to ensure that the overall thermally-induced expansions or contractions of the sub-links 16*a*–16*d* and 18*a*–18*d* are compensated for to maintain the design, or nominal distance x between the printheads 11 and 13. Necessarily, the 4-fold configuration requires additional linking structures 17 between the various layers 24, 26, 28 and 30 of the sub-links 16*a*–16*d* and 18*a*–18*d* to achieve the same design, or nominal, distance x between the printheads 11 and 13.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A multi-actuator device that is insensitive to thermally-induced position shifts between actuators, comprising:

a support;

a plurality of actuators, including a first actuator fixed to the support and at least one other actuator;

at least one connection structure, each respective connection structure connecting the first actuator to a corresponding one of the at least one other actuator, each connection structure comprising a plurality of links, including at least a first link connected to the first actuator and a second link connected to that one of the at least one other actuator, wherein the plurality of links are formed of at least two different materials, each material having a coefficient of thermal expansion, lengths of the plurality of links and the coefficients of thermal expansion cooperating to substantially maintain the other actuator at substantially the same distance from the fixed actuator.

2. The multi-actuator device of claim 1, wherein the actuators are printheads that direct ink droplets upon a recording medium.

3. The multi-actuator device of claim 2, wherein each first link has a positive length equal to $nL_1$ and each second link as a length $nL_2$, where n is a positive number.

4. The multi-actuator device of claim 3, wherein the first actuator is a nominal distance x from at least one other actuator, such that $nL_1-nL_2=nx$.

5. The multi-actuator device of claim 3, wherein the material forming one first link has a first coefficient of thermal expansion $\mu_1$ and the material forming one second link has a second coefficient of thermal expansion $\mu_2$.

6. The multi-actuator device of claim 5, wherein the lengths and coefficients of thermal expansion of those first and second links are related such that $\mu_1L_1=\mu_2L_2$.

7. The multi-actuator device of claim 5, wherein the lengths and coefficients of thermal expansion of those first and second links are related such that $\mu_1L_1=\mu_2L_2$.

8. The multi-actuator device of claim 1, wherein one of the at least one connection structure comprises a linking structure connecting a first link to a second link.

9. The multi-actuator device of claim 1, wherein one of the at least one connection structure comprises:

a third link; and a first linking structure connecting the third link to the first link.

10. The multi-actuator of claim 9, wherein:

the first link and the second link are made of a first material having a coefficient of thermal expansion $\mu_1$, the first link having a length L, and the second link having a length $L_2$;

the third link has a length $L_3$ and is formed of a second material that is different from the first material and that has a coefficient of thermal expansion $\mu_2$;

$\mu_1 \neq \mu_2$; and $\mu_1(L_1+L_2)=\mu_2L_3$.

11. The multi-actuator of claim 9, further comprising a second linking structure that connects the third link to the second link.

12. The multi-actuator of claim 9, wherein:

the first link has a length $L_1$ and is made of a first material having a first coefficient of thermal expansion $\mu_1$;

the second link has a length $L_2$ and is made of a second material that is different than the first material and that has a second coefficient of thermal expansion $\mu_2$;

the third link has a length $L_3$ and is made of a third material that is different than the first and second materials and that has a third coefficient of thermal expansion $\mu_3$;

$\mu_1 \neq \mu_2 \neq \mu_3 \neq \mu_1$; and $(\mu_1 L_1)+(\mu_2 L_2)=\mu_3 L_3$.

13. The multi-actuator device of claim 1, wherein one of the at least one connection structure comprises:

a third link;

a fourth link;

a first linking structure connecting the third link to the first link; and a second linking structure connecting the fourth link to the second link.

14. The multi-actuator of claim 13, wherein:

the first link and the fourth link are made of a first material having a coefficient of thermal expansion $\mu_1$, the first link having a length L, and the fourth link having a length $L_4$;

the second link and the third link are formed of a second material that is different from the first material and that has a coefficient of thermal expansion $\mu_2$, the second link having a length $L_2$ and the third link having a length $L_3$;

$\mu_1 \neq \mu_2$; and $\mu_1(L_1+L_3)=\mu_2(L_2+L_4)$.

15. The multi-actuator of claim 13, wherein:

the first link has a length $L_1$ and is made of a first material having a first coefficient of thermal expansion $\mu_1$;

the second link has a length $L_2$ and is made of a second material that is different than the first material and that has a second coefficient of thermal expansion $\mu_2$;

the third link has a length $L_3$ and is made of a third material that is different than the first and second materials and that has a third coefficient of thermal expansion $\mu_3$;

the fourth link has a length $L_4$ and is made of a fourth material that is different than the first and second materials and that has a fourth coefficient of thermal expansion $\mu_4$;

$\mu_4 \neq \mu_1 \neq \mu_2 \neq \mu_3 \neq \mu_1$;

$\mu_2 \neq \mu_4 \neq \mu_3$;

$(\mu_1 L_1)+(\mu_4 L_4)=(\mu_3 L_3)+(\mu_2 L_2)$.

16. The multi-actuator device of claim 13, wherein:

the first link has a length $L_1$ and is made of a first material having a first coefficient of thermal expansion $\mu_1$;

the second link has a length $L_2$ and is made of a second material that is different than the first material and that has a second coefficient of thermal expansion $\mu_2$;

the third link has a length $L_3$ and is made of a third material having a third coefficient of thermal expansion $\mu_3$;

the fourth link has a length $L_4$ and is made of the first material;

$\mu_1 \neq \mu_2 \neq \mu_3 \neq \mu_1$; and $\mu_1 (L_1+L_4)=\mu_2 L_2+\mu_3 L_3$.

17. The multi-actuator device of claim 13, wherein:

the first link has a length $L_1$ and is made of a first material having a first coefficient of thermal expansion $\mu_1$;

the second link has a length $L_2$ and is made of a second material that is different than the first material and that has a second coefficient of thermal expansion $\mu_2$;

the third link has a length $L_3$ and is made of the second material;

the fourth link has a length $L_4$ and is made of a third material having a third coefficient of thermal expansion $\mu_3$;

$\mu_1 \neq \mu_2 \neq \mu_3 \neq \mu_1$; and $\mu_2(L_2+L_3)=\mu_1 L_1+\mu_3 L_4$.

18. The multi-actuator of claim 13, further comprising a second linking structure that connects the third link to the fourth link.

19. The multi-actuator device of claim 1, wherein:

the connection structure comprises a plurality of links including at least the first and second links;

the plurality of links is divided into a first subset i and a second subset j;

the plurality of links is organized into at least one layer, each layer including one or two of the plurality of links, at least one layer including two of the plurality of links;

each layer that contains two links includes one link from each of the first and second subsets;

each link of the plurality of links has a length L and is formed of a material having a coefficient of thermal expansion $\mu$; and $$\sum_{m=1}^{i} \mu_m L_m = \sum_{n=1}^{j} \mu_n L_n$$

where:

$\mu_m$ is the coefficient of thermal expansion of an $m^{th}$ link of the first subset i of the plurality of links;

$L_m$ is the length of the $m^{th}$ link of the first subset i of the plurality of links;

$\mu_n$ is the coefficient of thermal expansion of an $n^{th}$ link of the second subset j of the plurality of links; and $L_n$ is the length of the $n^{th}$ link of the first subset j of the plurality of links.

20. The multi-actuator device of claim 19, wherein the coefficient of thermal expansion $\mu_m$ of each of the m links of the first subset i of the plurality of links is the same.

21. The multi-actuator device of claim 20, wherein the coefficient of thermal expansion $\mu_n$ of each of the n links of the second subset j of the plurality of links is the same.

22. The multi-actuator device of claim 21, wherein, for at least two of the the n links of the second subset j of the plurality of links, those at least two links are formed of the same materials.

23. The multi-actuator device of claim 21, wherein the n links of the second subset j of the plurality of links are formed of the same materials.

24. The multi-actuator device of claim 20, wherein, for at least two of the the n links of the second subset j of the plurality of links, the coefficients of thermal expansion $\mu_n$ of those at least two links are different from each other.

25. The multi-actuator device of claim 24, wherein, for at least those two of the the n links of the second subset j of the plurality of links, those at least two links are formed of different materials.

26. The multi-actuator device of claim 20, wherein the coefficients of thermal expansion $\mu_n$ of the n links of the second subset j of the plurality of links are different from each other.

27. The multi-actuator device of claim 26, wherein the material used to form each of the n links of the second subset j of the plurality of links is different from each of the other links of the second subset j of the plurality of links.

28. The multi-actuator device of claim 20, wherein, for at least two of the the m links of the first subset i of the plurality of links, those at least two links are formed of the same materials.

29. The multi-actuator device of claim 20, wherein the m links of the first subset i of the plurality of links are formed of the same materials.

30. The multi-actuator device of claim 19, wherein, for at least two of the the m links of the first subset i of the plurality of links, the coefficients of thermal expansion $\mu_m$ of those at least two links are different from each other.

31. The multi-actuator device of claim 30, wherein the coefficient of thermal expansion $\mu_n$ of each of the n links of the second subset j of the plurality of links is the same.

32. The multi-actuator device of claim 31, wherein, for at least two of the the n links of the second subset j of the plurality of links, those at least two links are formed of the same materials.

33. The multi-actuator device of claim 31, wherein the n links of the second subset j of the plurality of links are formed of the same materials.

34. The multi-actuator device of claim 30, wherein, for at least two of the the n links of the second subset j of the plurality of links, the coefficients of thermal expansion $\mu_n$ of those at least two links are different from each other.

35. The multi-actuator device of claim 34, wherein, for at least those two of the the n links of the second subset j of the plurality of links, those at least two links are formed of different materials.

36. The multi-actuator device of claim 30, wherein the coefficients of thermal expansion $\mu_n$ of the n links of the second subset j of the plurality of links are different from each other.

37. The multi-actuator device of claim 36, wherein the material used to form each of the n links of the second subset j of the plurality of links is different from each of the other links of the second subset j of the plurality of links.

38. The multi-actuator device of claim 30, wherein, for at least those two of the the m links of the first subset i of the plurality of links, those at least two links are formed of different materials.

39. The multi-actuator device of claim 30, wherein the coefficients of thermal expansion $\mu_m$ of the m links of the first subset i of the plurality of links are different from each other.

40. The multi-actuator device of claim 39, wherein the material used to form each of the m links of the first subset i of the plurality of links is different from each of the other links of the first subset i of the plurality of links.

41. The multi-actuator device of claim 1, wherein the actuators are printheads usable to form an image on a recording medium.

42. The multi-actuator device of claim 41, wherein the printheads are ink jet printheads.

43. The multi-actuator device of claim 42, wherein the ink jet printheads are acoustic ink jet printheads.

44. The multi-actuator device of claim 42, wherein the ink jet printheads are full-width array ink jet printheads.

45. The multi-actuator device of claim 44, wherein the support is a frame of a full-width ink jet printer.

46. The multi-actuator device of claim 42, wherein the support is a carriage of a cartridge-type ink jet printer.

47. The multi-actuator device of claim 1, wherein the actuators are sensor heads, each sensor head usable to detect at least one characteristic of an object.

48. The multi-actuator device of claim 47, wherein the sensor heads are image data sensing devices.

49. The multi-actuator device of claim 48, wherein the image data sensing devices are charge-coupled device arrays.

50. The multi-actuator device of claim 49, wherein the charge coupled device arrays are full-width charge-coupled device arrays.

51. The multi-actuator device of claim 50, wherein the support is a frame of a full-width image data sensing apparatus.

52. The multi-actuator device of claim 49, wherein the charge coupled device arrays are cartridge-type charge-coupled device arrays.

53. The multi-actuator device of claim 52, wherein the support is a carriage of an apparatus capable of receiving the cartridge type charge-coupled device arrays.

54. The multi-actuator device of claim 49, wherein each charge-coupled device array senses a different color of the object.

* * * * *